US009109189B2

(12) United States Patent
Perez-Prat Vinuesa et al.

(10) Patent No.: US 9,109,189 B2
(45) Date of Patent: Aug. 18, 2015

(54) LIQUID DETERGENT COMPOSITION

(75) Inventors: Eva Maria Perez-Prat Vinuesa, Brussels (BE); Anna Asmanidou, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 200 days.

(21) Appl. No.: 13/191,491

(22) Filed: Jul. 27, 2011

(65) Prior Publication Data

US 2012/0028873 A1 Feb. 2, 2012

(30) Foreign Application Priority Data

Jul. 29, 2010 (EP) ..... 10171310
May 18, 2011 (EP) ..... 11166540

(51) Int. Cl.

*C11D 3/386* (2006.01)
*C11D 3/18* (2006.01)
*C11D 3/20* (2006.01)
*C11D 17/00* (2006.01)

(52) U.S. Cl.

CPC ..... *C11D 3/38618* (2013.01); *C11D 3/18* (2013.01); *C11D 3/2093* (2013.01); *C11D 17/0026* (2013.01)

(58) Field of Classification Search

CPC ..... C11D 17/0026; C11D 17/0013; C11D 3/386; C11D 3/38618

See application file for complete search history.

(56) References Cited

U.S. PATENT DOCUMENTS

| | | | | |
|---|---|---|---|---|
| 3,943,234 | A | 3/1976 | Roggenkamp | |
| 4,760,025 | A | 7/1988 | Estell et al. | |
| 4,906,396 | A | 3/1990 | Falholt et al. | |
| 5,030,378 | A | 7/1991 | Venegas | |
| 5,545,344 | A | 8/1996 | Durbut et al. | |
| 5,599,400 | A | 2/1997 | Mao et al. | |
| 5,679,630 | A | 10/1997 | Baeck et al. | |
| 5,990,065 | A * | 11/1999 | Vinson et al. | 510/237 |
| 6,008,181 | A | 12/1999 | Cripe et al. | |
| 6,020,303 | A | 2/2000 | Cripe et al. | |
| 6,060,443 | A | 5/2000 | Cripe et al. | |
| 6,221,829 | B1 | 4/2001 | Symes et al. | |
| 6,242,405 | B1 | 6/2001 | Lykke et al. | |
| 6,274,540 | B1 | 8/2001 | Scheibel et al. | |
| 6,306,817 | B1 | 10/2001 | Kott et al. | |
| 6,312,936 | B1 | 11/2001 | Poulose et al. | |
| 6,359,031 | B1 | 3/2002 | Lykke et al. | |
| 6,362,147 | B1 * | 3/2002 | Castro et al. | 510/235 |
| 6,369,012 | B1 * | 4/2002 | Kasturi et al. | 510/237 |
| 6,514,926 | B1 | 2/2003 | Kott et al. | |
| 6,521,577 | B1 * | 2/2003 | Clarke et al. | 510/237 |
| 6,566,319 | B1 | 5/2003 | Scheibel et al. | |
| 6,579,698 | B1 * | 6/2003 | Saunders et al. | 435/69.1 |
| 6,583,096 | B1 | 6/2003 | Kott et al. | |
| 6,602,840 | B1 | 8/2003 | Scheibel et al. | |
| 6,827,795 | B1 * | 12/2004 | Scheper et al. | 134/42 |
| 7,008,618 | B1 | 3/2006 | Hessefort et al. | |
| 7,713,921 | B2 | 5/2010 | Boutique et al. | |
| 7,776,347 | B2 | 8/2010 | Kerschner et al. | |
| 7,838,511 | B2 | 11/2010 | Lichtenberger et al. | |
| 2002/0032142 | A1 * | 3/2002 | Smets et al. | 510/305 |
| 2002/0037824 | A1 * | 3/2002 | Smets et al. | 510/305 |
| 2004/0018950 | A1 | 1/2004 | Foley et al. | |
| 2006/0105936 | A1 * | 5/2006 | Shi et al. | 510/503 |
| 2006/0264344 | A1 * | 11/2006 | Goldberg et al. | 510/130 |
| 2006/0281653 | A1 | 12/2006 | Hutton et al. | |
| 2007/0027050 | A1 * | 2/2007 | Crotty et al. | 510/130 |
| 2007/0241306 | A1 | 10/2007 | Wehner et al. | |
| 2007/0287648 | A1 * | 12/2007 | Moaddel et al. | 510/130 |
| 2008/0029360 | A1 | 2/2008 | Yamashita et al. | |
| 2009/0069207 | A1 | 3/2009 | Panandiker et al. | |
| 2010/0197548 | A1 * | 8/2010 | Bettiol et al. | 510/236 |
| 2010/0197554 | A1 * | 8/2010 | Koyuncu et al. | 510/236 |
| 2011/0237685 | A1 | 9/2011 | Huchel et al. | |

FOREIGN PATENT DOCUMENTS

| | | | |
|---|---|---|---|
| CA | 2019350 | | 12/1990 |
| EP | 410567 | A2 | 1/1991 |
| EP | 342177 | B1 | 7/1995 |
| JP | A2004-300396 | | 10/2004 |
| JP | A-2005-187548 | | 7/2005 |
| WO | WO-89/06270 | A1 | 7/1989 |
| WO | WO-98/15638 | A2 | 4/1998 |
| WO | WO 98/39404 | A1 | 9/1998 |
| WO | WO-99/05084 | A1 | 2/1999 |
| WO | WO-99/05242 | A1 | 2/1999 |
| WO | WO-99/05244 | A1 | 2/1999 |
| WO | WO-99/07656 | A2 | 2/1999 |
| WO | WO-2005/052156 | A2 | 6/2005 |
| WO | WO-2008/046778 | A1 | 4/2008 |

OTHER PUBLICATIONS

European Search Report for Application No. 10171310.5-2114, dated Jan. 26, 2011, containing 8 pages.

European Search Report for Application No. 11166540.0/2114, dated Oct. 18, 2011, containing 7 pages.

PCT Search Report for International Application No. PCT/US2011/045437, dated Oct. 18, 2011, containing 11 pages.

* cited by examiner

*Primary Examiner* — Gregory Webb
(74) *Attorney, Agent, or Firm* — Amy Ahn-Roll

(57) ABSTRACT

A dishwashing composition comprising a hydrophobic emollient and an enzyme, preferably a protease, to provide improved hand skin care benefits and superior cleaning and/or suds mileage.

12 Claims, No Drawings

LIQUID DETERGENT COMPOSITION

FIELD OF INVENTION

The present invention relates to a dishwashing composition comprising a hydrophobic emollient and a protease, to provide improved hand skin care benefits and superior cleaning and/or suds mileage.

BACKGROUND OF THE INVENTION

During the manual dishwashing process, hands of users are exposed to dishwashing detergents. Such compositions comprise surfactants and other ingredients which can damage the skin and/or cause skin irritation and dryness. Some users will therefore feel the need to apply soothing or moisturizing cream in order to restore moisturization, after the dishwashing process.

EP0410567 and WO2008046778 illustrate liquid dishwashing detergent compositions comprising low levels of emollients to give skin care benefit.

However, there remains an unmet need for a shelf stable liquid dishwashing composition that prevents skin damage and even provides superior moisture maintenance, improved skin feel and skin appearance, while not affecting the cleaning and sudsing performance of said liquid dishwashing composition.

It has been found that liquid dishwashing compositions comprising a combination of a protease and hydrophobic emollient does provide the right equilibrium between the necessary improvement in skin care, especially sensory benefits such as skin smoothness, softness, suppleness, and improved skin appearance, as well as the superior cleaning, shine and suds. A further advantage of the present invention is that the skin care benefit can be delivered under the variable conditions typically found during dishwashing such as from neat application to dilute conditions.

SUMMARY OF THE INVENTION

The present application relates to a liquid dishwashing composition comprising a hydrophobic emollient and a protease, wherein the protease is comprised at a level of from 0.00001% to 1%, preferably from 0.0001% to 0.5%, more preferably from 0.0001% to 0.1% enzyme protein by weight of the total composition.

DETAILED DESCRIPTION OF THE INVENTION

As used herein "grease" means materials comprising at least in part (i.e., at least 0.5 wt % by weight of the grease) saturated and unsaturated fats and oils, preferably oils and fats derived from animal sources, such as beef and/or chicken, and/or vegetable sources.

As used herein "shelf stable" means a neat hand dish liquid cleansing composition that under ambient conditions does not phase separate for at least two weeks, preferably for at least six months, and more preferably never.

As used herein "hydration" means optimization of the water level in the skin through importing water from outside into the skin.

As used herein "moisturization" means optimization of the water level in the skin through hydration and/or through minimization of water loss from the skin via water binding, occlusion and/or the improvement of the skin barrier condition.

As used herein "dishware" refers to a hard surface such as dishes, glasses, pots, pans, baking dishes and flatware made from ceramic, china, metal, glass, plastic (polyethylene, polypropylene, polystyrene, etc.) and wood.

As used herein "liquid dishwashing detergent composition" refers to those compositions that are employed in manual (i.e. hand) dishwashing. Such compositions are generally high sudsing or foaming in nature and are shelf stable.

A used herein "hand skin care benefit" means any benefit relating to hand skin appearance (such as smoothness, elasticity, absence of redness and absence of lines and wrinkles), skin feel (such as softness and suppleness), and skin moisture level.

As used herein "suds profile" means amount of sudsing (high or low) and the persistence of sudsing (sustained or prevention) throughout the washing process resulting from the use of the liquid detergent composition of the present composition. Liquid dishwashing detergent compositions require high sudsing and sustained suds. This is particularly important with respect to liquid dishwashing detergent compositions as the consumer uses high sudsing as an indicator of the performance of the detergent composition. Moreover, the consumer in a liquid dishwashing detergent composition also uses the sudsing profile as an indicator that the wash solution still contains active detergent ingredients. The consumer usually renews the wash solution when the sudsing subsides. Thus, a low sudsing liquid dishwashing detergent composition formulation will tend to be replaced by the consumer more frequently than is necessary because of the low sudsing level.

Liquid Composition

The composition of the present invention is formulated as a liquid dishwashing detergent composition comprising a hydrophobic emollient and a protease.

The liquid dishwashing compositions herein may further contain from 30% to 90% by weight of an aqueous liquid carrier in which the other essential and optional composition components are dissolved, dispersed or suspended. Preferably the aqueous liquid carrier will comprise from 45% to 70%, more preferably from 45% to 65% by weight of the compositions herein described. One preferred component of the aqueous liquid carrier is water. The aqueous liquid carrier, however, may contain other materials which are liquid, or which dissolve in the liquid carrier, at room temperature (20° C.-25° C.) and which may also serve some other function besides that of an inert filler. Such materials can include, for example, hydrotropes and solvents, discussed in more detail below.

The liquid dishwashing composition may have any suitable pH. Preferably the pH of the composition is adjusted to between 4 and 14. More preferably the composition has pH of between 6 and 13, most preferably between 6 and 10. The pH of the composition can be adjusted using pH modifying ingredients known in the art. Dependent on the geographical of use of the composition, the water used in the method of the present invention can have a hardness level of about 2-30 gpg ("gpg" is a measure of water hardness that is well known to those skilled in the art, and it stands for "grains per gallon").

The Hydrophobic Emollient

The composition of present invention comprises one or more hydrophobic emollients. Hydrophobic emollients are agents that soften or soothe the skin by slowing the evaporation of water. Hydrophobic emollients form an oily layer on the surface of the skin that slows water loss increasing skin moisture content and skin water holding capacity. Hydrophobic emollients lubricate the skin and enhance skin barrier function improving skin elasticity and appearance.

Preferably, the liquid dishwashing composition according to the present invention comprises high levels of hydrophobic emollient, typically up to 10% by weight. The hydrophobic emollient is preferably present from 0.25% to 10%, more preferably from 0.3% to 8%, most preferably from 0.5% to 6% by weight of the total composition.

Hydrophobic emollients suitable for use in the compositions herein are hydrocarbon oils and waxes; silicones; fatty acid derivatives; glyceride esters, di and tri-glycerides, acetoglyceride esters; alkyl and alkenyl esters; cholesterol and cholesterol derivatives; vegetable oils, vegetable oil derivatives, liquid nondigestible oils, or blends of liquid digestible or nondigestible oils with solid polyol polyesters; natural waxes such as lanolin and its derivatives, beeswax and its derivatives, spermaceti, candelilla, and carnauba waxes; phospholipids such as lecithin and its derivatives; sphingolipids such as ceramide; and homologs thereof and mixtures thereof.

Examples of suitable Hydrocarbon Oils and Waxes include: petrolatum, mineral oil, micro-crystalline waxes, polyalkenes (e.g. hydrogenated and nonhydrogenated polybutene and polydecene), paratrins, cerasin, ozokerite, polyethylene and perhydrosqualene. Preferred hydrocarbon oils are petrolatum and/or blends of petrolatum and mineral oil.

Examples of suitable Silicone Oils include: dimethicone copolyol, dimethylpolysiloxane, diethylpolysiloxane, high molecular weight dimethicone, mixed $C_{1-30}$alkyl polysiloxane, phenyl dimethicone, dimethiconol, and mixtures thereof. More preferred are non-volatile silicones selected from dimethicone, dimethiconol, mixed $C_{1-30}$alkyl polysiloxane, and mixtures thereof.

Examples of suitable glyceride esters include: castor oil, soy bean oil, derivatized soybean oils such as maleated soy bean oil, safflower oil, cotton seed oil, corn oil, walnut oil, peanut oil, olive oil, cod liver oil, almond oil, avocado oil, vegetable oils and vegetable oil derivatives; coconut oil and derivatized coconut oil, cottonseed oil and derivatized cottonseed oil, jojoba oil, cocoa butter, and the like. Preferred glyceride is castor oil.

Acetoglyceride esters may also be used, an example being acetylated monoglycerides.

Preferred hydrophobic emollients are petrolatum, mineral oil and/or blends of petrolatum and mineral oil; tri-glycerides such as the ones derived from vegetable oils; oily sugar derivatives; beeswax; lanolin and its derivatives including but not restricted to lanolin oil, lanolin wax, lanolin alcohols, lanolin fatty acids, isopropyl lanolate, cetylated lanolin, acetylated lanolin alcohols, lanolin alcohol linoleate, lanolin alcohol riconoleate; ethoxylated lanolin.

More preferred hydrophobic emollients are petrolatum; blends of petrolatum and mineral oil wherein the ratio petrolatum:mineral oil ranks from 90:10 to 50:50, and preferably is 70:30; vegetable oils and vegetable waxes such as castor oil, and carnauba wax; blends of petrolatum and vegetable oils such as castor oil; oily sugar derivatives such as the ones taught in WO98/16538. WO98/16538 describes cyclic polyol derivatives or reduced saccharide derivatives resulting from 35% to 100% of the hydroxyl group of the cyclic polyol or reduced saccharide being esterified and/or etherified and in which at least two or more ester or ether groups are independently attached to a C8 to C22 alkyl or alkenyl chain, that may be linear or branched. In the context of the present invention, the term cyclic polyol encompasses all forms of saccharides. Especially preferred are monosaccharides and disaccharides. Examples of monosaccharides include xylose, arabinose, galactose, fructose, and glucose. Example of reduced saccharide is sorbitan. Examples of disaccharides are sucrose, lactose, maltose and cellobiose. Sucrose is especially preferred. Particularly preferred are sucrose esters with 4 or more ester groups. These are commercially available under the trade name Sefose® from Procter & Gamble Chemicals, Cincinnati Ohio.

Even more preferred hydrophobic emollients are petrolatum, mineral oil, Castor oil, natural waxes such as beeswax, carnauba, spermaceti, lanolin and lanolin derivatives such as liquid lanolin or lanolin oil sold by Croda International under the trade name of Fluilan, and lanolin derivatives such as ethoxylated lanolin sold by Croda International under the trade name of Solan E (PEG-75 lanolin). Most preferred hydrophobic emollients are petrolatum, mineral oil, Castor oil, and mixtures thereof.

Enzymes

The composition of the present invention comprises an enzyme such as an amylase, a protease, a cellulase, a mannanase, a pectinase, a xyloglucanase and/or a lipase; preferably an amylase, protease and/or lipase, more preferably a protease. It has been found that the combination of a protease and a hydrophobic emollient does provide the desired superior level of cleaning while providing superior hand feel and mildness to the hands, as well as superior moisturization. Indeed, it is believed that protease promotes exfoliation therefore revealing a relatively more moisturized surface. The hydrophobic emollient then forms an oily layer on the skin that slows water loss and improves skin moisture content and water holding capacity, providing improved skin condition. In addition to the exfoliation benefits it is believed that the addition of a protease enhances cleaning of protein containing soils such as egg, milk and meat typically found on the surface of soiled dishes.

Suitable proteases include those of animal, vegetable or microbial origin. Microbial origin is preferred. Chemically or genetically modified mutants are included. The protease may be a serine protease, preferably an alkaline microbial protease or a trypsin-like protease. Examples of neutral or alkaline proteases include:

(a) subtilisins (EC 3.4.21.62), especially those derived from *Bacillus*, such as *Bacillus lentus, B. alkalophilus, B. subtilis, B. amyloliquefaciens, Bacillus licheniformis, Bacillus pumilus* and *Bacillus gibsonii*, and *Cellumonas* described in U.S. Pat. No. 6,312,936 B1, U.S. Pat. No. 5,679,630, U.S. Pat. No. 4,760,025, U.S. Pat. No. 5,030,378, WO 05/052146, DEA6022216A1 and DEA 6022224A1.

(b) trypsin-like proteases are trypsin (e.g., of porcine or bovine origin) and the *Fusarium* protease described in WO 89/06270.

(c) metalloproteases, especially those derived from *Bacillus amyloliquefaciens* described in WO 07/044,993A2.

Preferred proteases for use herein include polypeptides demonstrating at least 90%, preferably at least 95%, more preferably at least 98%, even more preferably at least 99% and especially 100% identity with the wild-type enzyme from *Bacillus lentus* or the wild-type enzyme from *Bacillus amyloliquefaciens*, comprising mutations in one or more of the following positions, using the BPN' numbering system and amino acid abbreviations as illustrated in WO00/37627, which is incorporated herein by reference: 3, 4, 68, 76, 87, 99, 101, 103, 104, 118, 128, 129, 130, 159, 160, 167, 170, 194, 199, 205, 217, 222, 232, 236, 245, 248, 252, 256 & 259.

More preferred proteases are those derived from the BPN' and Carlsberg families, especially the subtilisin BPN' protease derived from *Bacillus amyloliquefaciens*. In one embodiment the protease is that derived from *Bacillus amyloliquefaciens*, comprising the Y217L mutation whose sequence is shown in standard 1-letter amino acid nomenclature, as described in EP342177A2 (pages 4, 5, 21 and 22).

Preferred commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, and those sold under the tradename Opticlean® and Optimase® by Solvay Enzymes. More preferred protease is a subtilisin BPN' protease derived from *Bacillus amyloliquefaciens*, preferably comprising the Y217L mutation, sold under the tradename Purafect Prime®, supplied by Genencor International.

Enzymes may be incorporated into the compositions in accordance with the invention at a level of from 0.00001% to 1% of enzyme protein by weight of the total composition, preferably at a level of from 0.0001% to 0.5% of enzyme protein by weight of the total composition, more preferably at a level of from 0.0001% to 0.1% of enzyme protein by weight of the total composition.

The aforementioned enzymes can be provided in the form of a stabilized liquid or as a protected liquid or encapsulated enzyme. Liquid enzyme preparations may, for instance, be stabilized by adding a polyol such as propylene glycol, a sugar or sugar alcohol, lactic acid or boric acid or a protease stabilizer such as 4-formyl phenyl boronic acid according to established methods. Protected liquid enzymes or encapsulated enzymes may be prepared according to the methods disclosed in U.S. Pat. No. 4,906,396, U.S. Pat. No. 6,221,829, U.S. Pat. No. 6,359,031 and U.S. Pat. No. 6,242,405.

The Crystalline Structurant

The present invention may further comprise one or more crystalline structurants which are materials that form a thread-like structuring system and/or an insoluble particle network throughout the matrix of the composition. The crystalline structurants may be crystallized in situ within the aqueous liquid matrix of the composition herein or within a pre-mix which is used to form such an aqueous liquid matrix. It has been found that the network generated by the crystalline wax structurant prevents the hydrophobic emollient droplets from coalescing and phase splitting in the product, thereby providing excellent stability of a hand dishwashing liquid composition. Such stability allows formulating higher levels of hydrophobic emollient without the need to over emulsify the emollient, process that can result in poor release of the hydrophobic emollient upon product usage which prevents the emollient from delivering the desired hand skin care benefit.

When present, said crystalline structurant will typically be comprised at a level of from 0.02% to 5%, preferably 0.025%-3%, more preferably from 0.05% to 2%, most preferably from 0.1% to 1.5% by weight of the total composition. Preferred crystalline structurants are: Hydroxyl-containing crystalline structuring agents such as a hydroxyl-containing fatty acid, fatty ester or fatty soap wax-like materials or the like such as the ones described in U.S. Pat. No. 6,080,707. Said crystalline hydroxyl-containing structuring agent is insoluble in water under ambient to near ambient conditions.

The preferred crystalline hydroxyl-containing structuring agent is selected from the group consisting of structuring agents with formula (I), (II), or mixtures thereof.

Formula (I)

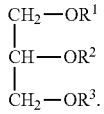

Wherein $R^1$ is the chemical moiety described below $R^1$ is

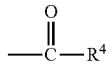

$R^2$ is $R^1$ or H $R^3$ is $R^1$ or H $R^4$ is independently $C_{10}$-$C_{22}$ alkyl or alkenyl comprising at least one hydroxyl group;

Formula II)

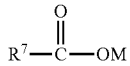

wherein: $R^7$ is $R^4$ as defined above in (I), M is $Na^+$, $K^+$, $Mg^{++}$ or $Al^{3+}$, or H, Some preferred hydroxyl-containing stabilizers include 12-hydroxystearic acid, 9,10-dihydroxystearic acid, tri-9,10-dihydroxystearin and tri-12-hydroxystearin. Tri-12-hydroxystearin is most preferred for use in the hand liquid dishwashing compositions herein.

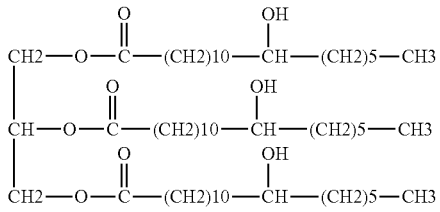

Trihydroxystearin

Castor wax or hydrogenated castor oil is produced by the hydrogenation (saturation of triglyceride fatty acids) of pure castor oil and is mainly composed of tri-12-hydroxistearin. Commercially available, castor oil-based, crystalline, hydroxyl-containing stabilizers include THIXCIN® from Rheox, Inc. (now Elementis).

It has been found that the crystalline stabilizing thread-like network formed by these stabilizers provides the composition of the present invention with a pseudoplastic or shear thinning rheology profile and with time-dependent recovery of viscosity after shearing (thixotropy).

Other suitable crystalline structurants are $C_{10-22}$ ethylene glycol fatty acid esters. $C_{10-22}$ ethylene glycol fatty acid esters can be used alone or in combination with other crystalline structurant such as hydrogenated castor oil. Typical examples are monoesters and/or diesters of ethylene glycol, propylene glycol, diethylene glycol, dipropylene glycol, triethylene glycol or tetraethylene glycol with fatty acids containing from about 6 to about 22, preferably from about 12 to about 18 carbon atoms, such as caproic acid, caprylic acid, 2-ethyhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid, erucic acid, and mixtures thereof.

The ester is preferably a diester, more preferably a $C_{14-18}$ diester, most preferably ethylene glycol distearate. There are several commercial sources for these materials: e.g. PEG6000MS® available from Stepan, Empilan EGDS/A® available from Albright & Wilson; and Euperlan PK900 Benz-W, Euperlan PK 3000 AM, and Euperlan PK 711 produced by Cognis Corp.

While not being bound by theory, it is believed that the ester forms an insoluble particle network, preferably platelet crystals, that prevents the coalescence of hydrophobic emollient particles, thus preventing phase separation of the product.

It has surprisingly been found that the stability of compositions according to the present invention can be further enhanced by using a combination of two different crystalline structurants to provide the insoluble particle network and thread-like network. Hence, in a preferred embodiment, the composition herein will comprise the combination of (a) typically 0.02%-5%, preferably 0.02%-3.5%, more preferably 0.02%-0.8% by weight of the composition of hydrogenated castor oil, and (b) typically 0.00001%-1.5% preferably 0.0001-1%, more preferably 0.0001-0.5% by weight of the composition of ethylene glycol distearate.

Blends of Hydrophobic Emollient and Crystalline Structurant

In a preferred embodiment, the liquid dishwashing composition according to the present invention comprises a blend of specific hydrophobic emollient and of a specific crystalline structurant. Preferably the hydrophobic emollient is a vegetable oil such as castor oil and the crystalline structurant is hydrogenated castor oil. A preferred blend of castor oil and hydrogenated castor oil is commercially available from Vertellus Specialties Inc: Castorlatum®.

Surfactants

A preferred further ingredient of the composition of the present invention is a surfactant selected from nonionic, anionic, cationic surfactants, amphoteric, zwitterionic, semi-polar nonionic surfactants, and mixtures thereof. Surfactants may be comprised at a level of from about 1.0% to about 50% by weight, preferably from about 5% to about 40% by weight, more preferably about 10% to about 30% by weight and even more preferably from about 5% to about 20% by weight of the liquid detergent composition. Non-limiting examples of suitable surfactants are discussed below.

In a preferred embodiment, an efficient but mild to hands surfactant system will typically comprise about 4% to about 40%, preferably about 6% to about 32%, more preferably about 11% to about 25%, and most preferably about 11% to about 18% by weight of the total composition of an anionic surfactant and so preferably with no more than about 15%, preferably no more than about 10%, more preferably no more than about 5% by weight of the total composition, of a sulfonate surfactant.

Suitable anionic surfactants to be used in the compositions and methods of the present invention are sulfate, sulfosuccinates, sulfonate, and/or sulfoacetate; preferably alkyl sulfate and/or alkyl ethoxy sulfates; more preferably a combination of alkyl sulfates and/or alkyl ethoxy sulfates with a combined ethoxylation degree less than about 5, preferably less than about 3, more preferably less than about 2.

In an alternative embodiment, the surfactant system could be based on high levels of nonionic surfactant (Such as about 10% to about 45%, preferably about 15 to about 40%, more preferably about 20 to about 35% by weight of the total composition), preferably combined with an amphoteric surfactant, and more preferably with a low level of anionic surfactant (such as less than 20%, preferably less than 10%, more preferably less than about 5% by weight of the total composition).

Sulphate Surfactants

Suitable sulphate surfactants for use in the compositions herein include water-soluble salts or acids of $C_{10}$-$C_{14}$ alkyl or hydroxyalkyl, sulphate and/or ether sulfate. Suitable counterions include hydrogen, alkali metal cation or ammonium or substituted ammonium, but preferably sodium.

Where the hydrocarbyl chain is branched, it preferably comprises $C_{1-4}$ alkyl branching units. The average percentage branching of the sulphate surfactant is preferably greater than 30%, more preferably from 35% to 80% and most preferably from 40% to 60% of the total hydrocarbyl chains.

The sulphate surfactants may be selected from $C_8$-$C_{20}$ primary, branched-chain and random alkyl sulphates (AS); $C_{10}$-$C_{18}$ secondary (2,3) alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. No. 6,020,303 and U.S. Pat. No. 6,060,443; mid-chain branched alkyl alkoxy sulphates as discussed in U.S. Pat. No. 6,008,181 and U.S. Pat. No. 6,020,303.

Alkyl Sulfosuccinates—Sulfoacetate

Other suitable anionic surfactants are alkyl, preferably dialkyl, sulfosuccinates and/or sulfoacetate. The dialkyl sulfosuccinates may be a $C_{6-15}$ linear or branched dialkyl sulfosuccinate. The alkyl moieties may be symmetrical (i.e., the same alkyl moieties) or asymmetrical (i.e., different alkyl moiety.es). Preferably, the alkyl moiety is symmetrical.

Sulfonate Surfactants

The compositions of the present invention will preferably comprise no more than 15% by weight, preferably no more than 10%, even more preferably no more than 5% by weight of the total composition, of a sulfonate surfactant. These include water-soluble salts or acids of $C_{10}$-$C_{14}$ alkyl or hydroxyalkyl, sulfonates; $C_{11}$-$C_{18}$ alkyl benzene sulfonates (LAS), modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulfonate (MES); and alpha-olefin sulfonate (AOS). These also include the paraffin sulfonates may be monosulfonates and/or disulfonates, obtained by sulphonating paraffins of 10 to 20 carbon atoms. The sulfonate surfactants also include the alkyl glyceryl sulfonate surfactants.

Amphoteric and Zwitterionic Surfactants

The amphoteric and zwitterionic surfactant may be comprised at a level of from 0.01% to 20%, preferably from 0.2% to 15%, more preferably 0.5% to 12% by weight of the liquid detergent composition. Suitable amphoteric and zwitterionic surfactants are amine oxides and betaines.

Most preferred are amine oxides, especially coco dimethyl amine oxide or coco amido propyl dimethyl amine oxide. Amine oxide may have a linear or mid-branched alkyl moiety. Typical linear amine oxides include water-soluble amine oxides of formula $R^1$—$N(R^2)(R^3)$→O, wherein $R^1$ is a $C_{8-18}$ alkyl moiety; $R^2$ and $R^3$ are independently selected from the group consisting of $C_{1-3}$ alkyl groups and $C_{1-3}$ hydroxyalkyl groups and preferably include methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "mid-branched" means that the amine oxide has one alkyl moiety having $n_1$ carbon atoms with one alkyl branch on the alkyl moiety having $n_2$ carbon atoms. The alkyl branch is located on the α carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Other suitable surfactants include betaines such alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R^3)—(CH_2)_m—[CH(OH)—CH_2]_Y—Y— \quad (I)$$

wherein $R^1$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue;

X is NH, $NR^4$ with $C_{1-4}$ Alkyl residue $R^4$, O or S, n a number from 1 to 10, preferably 2 to 5, in particular 3, x 0 or 1, preferably 1, $R^2$, $R^3$ are independently a $C_{1-4}$ alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido betaine of the formula (Ib), the sulfo betaines of the formula (Ic) and the amido sulfobetaine of the formula (Id);

$$R^1—N^+(CH_3)_2—CH_2COO^- \quad (Ia)$$

$$R^1—CO—NH(CH_2)_3—N^+(CH_3)_2—CH_2COO^- \quad (Ib)$$

$$R^1—N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3— \quad (Id)$$

in which $R^1$ has the same meaning as in formula I. Particularly preferred betaines are the Carbobetaine [wherein $Y^-$=$COO^-$], in particular the carbobetaine of the formula (Ia) and (Ib), more preferred are the alkylamidobetaine of the formula (Ib).

Examples of suitable betaines and sulfobetaine are the following [designated in accordance with INCI]: Almondamidopropyl of betaines, Apricotamidopropyl betaines, Avocadamidopropyl of betaines, Babassuamidopropyl of betaines, Behenamidopropyl betaines, Behenyl of betaines, betaines, Canolamidopropyl betaines, Capryl/Capramidopropyl betaines, Carnitine, Cetyl of betaines, Cocamidoethyl of betaines, Cocamidopropyl betaines, Cocamidopropyl Hydroxysultaine, Coco betaines, Coco Hydroxysultaine, Coco/Oleamidopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucamidopropyl Hydroxysultaine, Hydrogenated Tallow of betaines, Isostearam idopropyl betaines, Lauramidopropyl betaines, Lauryl of betaines, Lauryl Hydroxysultaine, Lauryl Sultaine, Milkamidopropyl betaines, Minkamidopropyl of betaines, Myristamidopropyl betaines, Myristyl of betaines, Oleamidopropyl betaines, Oleamidopropyl Hydroxysultaine, Oleyl of betaines, Olivamidopropyl of betaines, Palmam idopropyl betaines, Palm itam idopropyl betaines, Palmitoyl Carnitine, Palm Kernelamidopropyl betaines, Polytetrafluoroethylene Acetoxypropyl of betaines, Ricinoleamidopropyl betaines, Sesam idopropyl betaines, Soyamidopropyl betaines, Stearamidopropyl betaines, Stearyl of betaines, Tallowamidopropyl betaines, Tallowamidopropyl Hydroxysultaine, Tallow of betaines, Tallow Dihydroxyethyl of betaines, Undecylenamidopropyl betaines and Wheat Germamidopropyl betaines.

A preferred betaine is, for example, Cocoamidopropyl betaine (Cocoamidopropyl betaine).

A preferred surfactant system is a mixture of anionic surfactant and amphoteric or zwiterionic surfactants in a ratio within the range of 1:1 to 5:1, preferably from 1:1 to 3.5:1.

It has been found that such surfactant system will provide the excellent cleaning and suds profile required from a hand dishwashing liquid composition while being mild to the hands.

Nonionic Surfactants

Nonionic surfactant, when present as co-surfactant, is comprised in a typical amount of from 0.1% to 20%, preferably 0.5% to 15%, more preferably from 0.5% to 10% by weight of the liquid detergent composition. When present as main surfactant, it is comprised in a typical amount of from 0.1 to 45%, preferably 15 to 40%, more preferably 20 to 35% by weight of the total composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 moles of ethylene oxide per mole of alcohol.

Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose. Also suitable are alkylglycerol ethers and sorbitan esters.

Also suitable are fatty acid amide surfactants having the formula (IV):

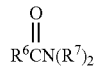

(IV)

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and —$(C_2H_4O)_xH$ where x of formula (IV) varies from 1 to 3. Preferred amides are $C_8$-$C_{20}$ ammonia amides, monoethanolamides, diethanolamides, and isopropanolamides.

Cationic Surfactants

Cationic surfactants, when present in the composition, are present in an effective amount, more preferably from 0.1% to 20%, by weight of the liquid detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is an $C_6$-$C_{18}$ alkyl or alkenyl ester of a quaternary ammonium alcohol, such as quaternary chlorine esters. More preferably, the cationic surfactants have the formula (V):

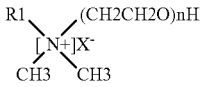

(V)

wherein $R^1$ of formula (V) is $C_8$-$C_{18}$ hydrocarbyl and mixtures thereof, preferably, $C_{8-14}$ alkyl, more preferably, $C_8$, $C_{10}$ or $C_{12}$ alkyl, and $X^-$ of formula (V) is an anion, preferably, chloride or bromide.

The Cationic Polymer

In a preferred embodiment, the liquid hand dishwashing compositions herein may comprise at least one cationic polymer for further enhanced skin benefits. Without wishing to be bound by theory, it is believed that the interaction of the cationic polymer with the anionic surfactant results in a phase separation phenomena known as coacervation which aids hydrophobic emollient deposition and enhances the deposition of the cationic polymer on the skin.

The cationic polymer will typically be present a level of from 0.001% to 10%, preferably from 0.01% to 5%, more preferably from 0.05% to 1%, by weight of the total composition.

Suitable cationic polymers for use in current invention contain cationic nitrogen containing moieties such as quaternary ammonium or cationic protonated amino moieties. The average molecular weight of the cationic polymer is between about 5000 to about 10 million, preferably at least about 100000, more preferably at least about 200000, but preferably not more than about 3000000. The polymers also have a cationic charge density ranging from about 0.1 meq/g to about 5 meq/g, preferably at least about 0.2 meq/g, more preferably at least about 0.3 meq/g, at the pH of intended use of the dishwashing liquid formulation. As used herein the "charge density" of the cationic polymers is defined as the number of cationic sites per polymer gram atomic weight (molecular weight), and can be expressed in terms of meq/gram of cationic charge. In general, adjustments of the proportions of amine or quaternary ammonium moieties in the polymer in function of the pH of the liquid dishwashing liquid in the case of amines, will affect the charge density. Any anionic counterions can be used in association with cationic deposition polymers, so long as the polymer remains soluble in water and in the liquid hand dishwashing liquid matrix, and so long that the counterion is physically and chemically stable with the essential components of this liquid hand dishwashing liquid, or do not unduly impair product performance, stability nor aesthetics. Non-limiting examples of such counterions include halides (e.g. chlorine, fluorine, bromine, iodine), sulphate and methylsulfate.

Specific examples of the water soluble cationized polymer include cationic polysaccharides such as cationized cellulose derivatives, cationized starch and cationized guar gum derivatives. Also included are synthetically derived copolymers such as homopolymers of diallyl quaternary ammonium salts, diallyl quaternary ammonium salt/acrylamide copolymers, quaternized polyvinylpyrrolidone derivatives, polyglycol polyamine condensates, vinylimidazolium trichloride/vinylpyrrolidone copolymers, dimethyldiallylammonium chloride copolymers, vinylpyrrolidone/quaternized dimethylaminoethyl methacrylate copolymers, polyvinylpyrrolidone/alkylamino acrylate copolymers, polyvinylpyrrolidone/alkylamino acrylate/vinylcaprolactam copolymers, vinylpyrrolidone/methacrylamidopropyl trimethylammonium chloride copolymers, alkylacrylamide acrylate alkylaminoalkylacrylamide/polyethylene glycol methacrylate copolymers, adipic acid/dimethylaminohydroxypropyl ethylenetriamine copolymer ("Cartaretin"—product of Sandoz/USA), and optionally quaternized/protonated condensation polymers having at least one heterocyclic end group connected to the polymer backbone through a unit derived from an alkylamide, the connection comprising an optionally substituted ethylene group (as described in WO 2007 098889, pages 2-19).

Specific non-limiting examples of commercial water soluble cationized polymers described generally above include: "Merquat 550" (a copolymer of acrylamide and diallyl dimethyl ammonium salt—CTFA name: Polyquaternium-7, product of ONDEO-NALCO), "Luviquat FC370" (a copolymer of 1-vinyl-2-pyrrolidone and 1-vinyl-3-methylimidazolium salt—CTFA name: Polyquaternium-16, product of BASF), "Gafquat 755N" (a copolymer of 1-vinyl-2-pyrrolidone and dimethylaminoethyl methacrylate—CTFA name: Polyquaternium-11, product ex ISP), "Polymer KG, "Polymer JR series" and "Polymer LR series" (salt of a reaction product between trimethyl ammonium substituted epoxide and hydroxyethyl cellulose—CTFA name: Polyquaternium-10, product of Amerchol) and "Jaguar series" (guar hydroxypropyl trimonium chloride, product of Rhodia) or "N-hance series" (guar hydroxypropyl trimonium chloride, product of Aqualon)

Preferred cationic polymers are cationic polysaccharides, more preferably cationic cellulose derivatives such as the salts of hydroxyethyl cellulose reacted with trimethyl ammonium substituted epoxide, referred to in the industry (CTFA) as Polyquaternium-10, such as the UCARE LR400, or UCARE JR-400 ex Dow Amerchol, even more preferred are cationic guar gum derivatives such as guar hydroxypropyltrimonium chloride, such as the Jaguar series ex Rhodia and N-Hance polymer series available from Aqualon.

Humectant

In a preferred embodiment the composition of the present invention may further comprise one or more humectants. It has been found that such composition comprising a humectant will provide additional hand skin mildness benefits.

When present, the humectant will typically be present in the composition of the present invention at a level of from 0.1% to 50%, preferably from 1% to 20%, more preferably from 1% to 10%, even more preferably from 1% to 6%, and most preferably from 2% to 5% by weight of the total composition.

Humectants that can be used according to this invention include those substances that exhibit an affinity for water and help enhance the absorption of water onto a substrate, preferably skin. Specific non-limiting examples of particularly suitable humectants include glycerol, diglycerol, polyethyleneglycol (PEG-4), propylene glycol, hexylene glycol, butylene glycol, (di)-propylene glycol, glyceryl triacetate, polyalkyleneglycols, and mixtures thereof. Others can be polyethylene glycol ether of methyl glucose, pyrrolidone carboxylic acid (PCA) and its salts, pidolic acid and salts such as sodium pidolate, polyols like sorbitol, xylitol and maltitol, or polymeric polyols like polydextrose or natural extracts like quillaia, or lactic acid or urea. Also included are alkyl polyglycosides, polybetaine polysiloxanes, and mixtures thereof. Additional suitable humectants are polymeric humectants of the family of water soluble and/or swellable polysaccharides such as hyaluronic acid, chitosan and/or a fructose rich polysaccharide which is e.g. available as Fucogel®1000 (CAS-Nr 178463-23-5) by SOLABIA S.

Humectants containing oxygen atoms are preferred over those containing nitrogen or sulphur atoms. More preferred humectants are polyols or are carboxyl containing such as glycerol, diglycerol, sorbitol, Propylene glycol, Polyethylene Glycol, Butylene glycol; and/or pidolic acid and salts thereof, and most preferred are humectants selected from the group consisting of glycerol (sourced from Procter & Gamble chemicals), sorbitol, sodium lactate, and urea, or mixtures thereof.

Pearlescent Agent

The composition herein may comprise as an optional ingredient one or more pearlescent agents. Suitable agents are crystalline or glassy solids, transparent or translucent compounds capable of reflecting and refracting light to produce a pearlescent effect. The composition of the present invention can typically comprise either an organic and/or an inorganic pearlescent agent.

When the composition of the present invention comprises an organic pearlescent agent, it is typically comprised at an active level of from 0.05% to 2.0%, preferably from 0.1% to 1.0% by weight of the total composition of the 100% active organic pearlescent agents.

When the composition of the present invention comprise an inorganic pearlescent agent, it is typically comprised at an active level of from 0.001% to 1.0%, preferably from 0.001% to 0.3%, and more preferably from 0.01% to 0.2% by weight of the composition of the 100% active inorganic pearlescent agents. Inorganic pearlescent agents include aluminosilicates and/or borosilicates. Preferred are the aluminosilicates and/or borosilicates which have been treated to have a very high refractive index, preferably silica, metal oxides, oxychloride coated aluminosilicate and/or borosilicates. More preferably inorganic pearlescent agent is mica, even more preferred titanium dioxide treated mica such as BASF Mearlin Superfine.

Other commercially available suitable inorganic pearlescent agents are available from Merck under the tradenames Iriodin, Biron, Xirona, Timiron Colorona, Dichrona, Candurin and Ronastar. Other commercially available inorganic pearlescent agent are available from BASF (Engelhard, Mearl) under tradenames Biju, Bi-Lite, Chroma-Lite, Pearl-Glo, Mearlite and from Eckart under the tradenames Prestige Soft Silver and Prestige Silk Silver Star.

Particle size (measured across the largest diameter of the sphere) of the pearlescent agent is typically below 200 microns, preferably below 100 microns, more preferably below 50 microns.

Cleaning Polymer

The liquid hand dishwashing composition herein may optionally further comprise one or more alkoxylated polyethyleneimine polymer. The composition may comprise from 0.01% to 10%, preferably from 0.01% to 2%, more preferably from 0.1% to 1.5%, even more preferable from 0.2% to 1.5% by weight of the total composition of an alkoxylated polyethyleneimine polymer as described on page 2, line 33 to page 5, line 5 and exemplified in examples 1 to 4 at pages 5 to 7 of WO2007/135645 The Procter & Gamble Company.

The alkoxylated polyethyleneimine polymer of the present composition has a polyethyleneimine backbone having from 400 to 10000 weight average molecular weight, preferably from 400 to 7000 weight average molecular weight, alternatively from 3000 to 7000 weight average molecular weight.

The alkoxylation of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety or benzyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

The composition may further comprise the amphiphilic graft polymers based on water soluble polyalkylene oxides (A) as a graft base and sides chains formed by polymerization of a vinyl ester component (B), said polymers having an average of ≤1 graft site per 50 alkylene oxide units and mean molar mass Mw of from 3,000 to 100,000 described in BASF patent application WO2007/138053 on pages 2 line 14 to page 10, line 34 and exemplified on pages 15-18.

Magnesium Ions

The optional presence of magnesium ions may be utilized in the detergent composition when the compositions are used in softened water that contains few divalent ions. When utilized, the magnesium ions preferably are added as a hydroxide, chloride, acetate, sulphate, formate, oxide or nitrate salt to the compositions of the present invention. When included, the magnesium ions are present at an active level of from 0.01% to 1.5%, preferably from 0.015% to 1%, more preferably from 0.025% to 0.5%, by weight of the liquid detergent composition.

Solvent

The present compositions may optionally comprise a solvent. Suitable solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. When present, the liquid detergent composition will contain from 0.01% to 20%, preferably from 0.5% to 20%, more preferably from 1% to 10% by weight of the liquid detergent composition of a solvent. These solvents may be used in conjunction with an aqueous liquid carrier, such as water, or they may be used without any aqueous liquid carrier being present.

Hydrotrope

The liquid detergent compositions of the invention may optionally comprise a hydrotrope in an effective amount so that the liquid detergent compositions are appropriately compatible in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, and related compounds, as disclosed in U.S. Pat. No. 3,915,903. The liquid detergent compositions of the present invention typically comprise from 0% to 15% by weight of the total liquid detergent composition of a hydrotrope, or mixtures thereof, preferably from 1% to 10%, most preferably from 3% to 10% by weight of the total liquid hand dishwashing composition.

Polymeric Suds Stabilizer

The compositions of the present invention may optionally contain a polymeric suds stabilizer. These polymeric suds stabilizers provide extended suds volume and suds duration of the liquid detergent compositions. These polymeric suds stabilizers may be selected from homopolymers of (N,N-dialkylamino) alkyl esters and (N,N-dialkylamino) alkyl acrylate esters. The weight average molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt.

One preferred polymeric suds stabilizer is (N,N-dimethylamino)alkyl acrylate esters. Other preferred suds boosting polymers are copolymers of hydroxypropylacrylate/dimethyl aminoethylmethacrylate (copolymer of HPA/DMAM).

When present in the compositions, the polymeric suds booster/stabilizer may be present from 0.01% to 15%, preferably from 0.05% to 10%, more preferably from 0.1% to 5%, by weight of the liquid detergent composition.

Another preferred class of polymeric suds booster polymers is hydrophobically modified cellulosic polymers having a number average molecular weight (Mw) below 45,000; preferably between 10,000 and 40,000; more preferably between 13,000 and 25,000. The hydrophobically modified cellulosic polymers include water soluble cellulose ether derivatives, such as nonionic and cationic cellulose derivatives. Preferred cellulose derivatives include methylcellulose, hydroxypropyl methylcellulose, hydroxyethyl methylcellulose, and mixtures thereof.

Diamines

Another optional ingredient of the compositions according to the present invention is a diamine. Since the habits and practices of the users of liquid detergent compositions show considerable variation, the composition will preferably contain 0% to 15%, preferably 0.1% to 15%, preferably 0.2% to 10%, more preferably 0.25% to 6%, more preferably 0.5% to 1.5% by weight of said composition of at least one diamine.

Preferred organic diamines are those in which pK1 and pK2 are in the range of 8.0 to 11.5, preferably in the range of 8.4 to 11, even more preferably from 8.6 to 10.75. Preferred materials include 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EP®) (pK1=10.5; pK2=8.9), 2-methyl 1,5 pentane diamine (DYTEK A®) (pK1=11.2; pK2=10.0). Other preferred materials include primary/primary diamines with alkylene spacers ranging from $C_4$ to $C_8$.

Carboxylic Acid

The liquid detergent compositions according to the present invention may comprise a linear or cyclic carboxylic acid or salt thereof to improve the rinse feel of the composition. The presence of anionic surfactants, especially when present in higher amounts in the region of 15-35% by weight of the composition, results in the composition imparting a slippery feel to the hands of the user and the dishware. This feeling of slipperiness is reduced when using the carboxylic acids as defined herein i.e. the rinse feel becomes draggy.

Carboxylic acids useful herein include $C_{1-6}$ linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred carboxylic acids are those selected from the group consisting of salicylic acid, maleic acid, acetyl salicylic acid, 3 methyl salicylic acid, 4 hydroxy isophthalic acid, dihydroxyfumaric acid, 1,2,4 benzene tricarboxylic acid, pentanoic acid and salts thereof and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof, when present, is preferably present at the level of from 0.1% to 5%, more preferably from 0.2% to 1% and most preferably from 0.25% to 0.5%, by weight of the total composition.

Other Optional Components:

The liquid detergent compositions herein can further comprise a number of other optional ingredients suitable for use in liquid detergent compositions such as perfume, dyes, opacifiers, enzymes, chelants, pH buffering means and rheology modifiers including those of the polyacrylate, polysaccharide or polysaccharide derivative type and/or a combination of a solvent and a polycarboxylate polymer. A further discussion of acceptable optional ingredients suitable for use in light-duty liquid detergent composition may be found in U.S. Pat. No. 5,798,505.

Thickness of the Composition

The liquid hand dishwashing compositions herein are preferably thickened and have preferably a viscosity from 50 to 5000 centipoises (50-5000 mPa*s), more preferably from 100 to 4000 centipoises (100-4000 mPa*s), even more preferably from 500-3500 centipoises (500-3500 mPa*s), and most preferably from 800 to 3000 centipoises (800-3000 mPa*s) at 20 $s^{-1}$ and 20° C. Viscosity can be determined by conventional methods. Viscosity according to the present invention is measured using an AR 550 rheometer from TA instruments using a plate steel spindle at 40 mm diameter and a gap size of 500 μm. The high shear viscosity at 20 s-1 and low shear viscosity at 0.05 $s^{-1}$ can be obtained from a logarithmic shear rate sweep from 0.1 $s^{-1}$ to 25 $s^{-1}$ in 3 minutes time at 20° C.

The preferred rheology described therein may be achieved using internal existing structuring with detergent ingredients or by employing an external rheology modifier and/or a crystalline structurant, which provides the composition with a pseudoplastic or shear thinning rheology profile and with time-dependent recovery of viscosity after shearing (thixotropy).

The Process of Cleaning/Treating a Dishware

In a preferred embodiment, the process of cleaning a dishware with a liquid dishwashing composition, comprising the hydrophobic emollient and protease described herein, comprises the step of applying said composition onto the dishware surface, typically in diluted or neat form and rinsing or leaving said composition to dry on said surface without rinsing said surface.

By "in its neat form", it is meant herein that said liquid composition is applied directly onto the surface to be treated and/or onto a cleaning device or implement such as a dish cloth, a sponge or a dish brush without undergoing any dilution by the user (immediately) prior to the application. By "diluted form", it is meant herein that said liquid composition is diluted by the user with an appropriate solvent, typically water. By "rinsing", it is meant herein contacting the dishware cleaned with the process according to the present invention with substantial quantities of appropriate solvent, typically water, after the step of applying the liquid composition herein onto said dishware. By "substantial quantities", it is meant usually 5 to 20 liters.

In one embodiment, the composition herein can be applied in its diluted form. Soiled dishes are contacted with an effective amount, typically from 0.5 ml to 20 ml (per 25 dishes being treated), preferably from 3 ml to 10 ml, of the liquid detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. Generally, from 0.01 ml to 150 ml, preferably from 3 ml to 40 ml of a liquid detergent composition of the invention is combined with from 2000 ml to 20000 ml, more typically from 5000 ml to 15000 ml of water in a sink having a volumetric capacity in the range of from 1000 ml to 20000 ml, more typically from 5000 ml to 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from 1 to 10 seconds, although the actual time will vary with each application and user. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from 1 to 5 seconds. The absorbing device, and consequently the undiluted liquid dishwashing composition, is then contacted individually to the surface of each of the soiled dishes to remove said soiling. The absorbing device is typically contacted with each dish surface for a period of time range from 1 to 10 seconds, although the actual time of application will be dependent upon factors such as the degree of soiling of the dish. The contacting of the absorbing device to the dish surface is preferably accompanied by concurrent scrubbing.

Alternatively, the device may be immersed in a mixture of the hand dishwashing composition and water prior to being contacted with the dish surface, said concentrated solution is made by diluting the hand dishwashing composition with water in a small container that can accommodate the cleaning device at ratios ranging from 95:5 to 5:95, preferably 80:20 to 20:80 and more preferably 70:30 to 30:70 of hand dishwashing liquid:water respectively depending upon the user habits and the cleaning task.

EXAMPLES

Liquid Dishwashing Detergent Compositions

| | Ex. 1 | Ex. 2 | Ex. 3 | Ex. 4 | Ex. 5 |
|---|---|---|---|---|---|
| Alkyl $C_{10-16}$ Ethoxy$_{0.2-4}$ Sulfate | 18% | 15% | 17% | 18% | — |
| Coco amido propyl Betaine | — | — | 9% | 5% | — |
| Ethoxylated alkyl alcohol | — | — | 1% | — | 33% |
| Di-methyl Coco Amine Oxide | 6% | 5.5% | — | 4% | 2% |
| Alkylpolyglucoside | — | — | — | 4% | — |
| Ethanol | — | — | 5% | 7% | 9% |
| Polypropyleneglycol | 1% | 0.8% | — | — | — |
| Citrate | — | — | 0.3% | 0.6% | — |
| NaCl | 1.2% | 1.0% | — | 0.5% | — |
| Sodium cumene sulfonate | — | — | 0.8% | — | 3% |
| Petrolatum | 2.1% | 1% | 7% | 0.7% | 3% |
| White mineral oil | 0.9% | — | 3% | 0.3% | 1% |
| Glycerol | — | 1% | 2% | — | — |
| cationic polymer (1) | 0.2% | 0.15% | — | 0.3% | — |
| Protease (ppm) Purafect Prime ™ from Genencor | 60 | 50 | 70 | 30 | 40 |
| Ethylene glycol distearate | 0.5% | — | — | 1% | 0.05% |
| Hydrogenated Castor Oil | 0.28% | 0.6% | 1.5% | — | 0.35% |
| Mica (BASF Mearlin superfine) | — | 0.05 | 0.1 | — | 0.02 |
| Minors* | Balance to 100% with water | | | | |
| pH | 9 | 9 | 6 | 6 | 7 |

| | Ex. 6 | Ex. 7 | Ex. 8 | Ex. 9 | Ex. 10 |
|---|---|---|---|---|---|
| Linear Alkylbenzene Sulfonate | — | — | 12% | 7% | 2% |
| Alkyl $C_{10-16}$ Ethoxy$_{0.2-4}$ Sulfate | 9% | 25% | 11% | — | — |
| Paraffin Sulfonate | 20% | — | — | — | — |

-continued

| | | | | | |
|---|---|---|---|---|---|
| Coco amido propyl Betaine | 4% | 1.5% | — | — | 2% |
| Ethoxylated alkyl alcohol | 6% | 0.4% | 0.6% | 2% | 32% |
| Di-methyl Coco Amine Oxide | — | — | 5% | 0.5% | — |
| Ethanol | 3% | — | 4% | — | 8% |
| Polypropyleneglycol | — | — | — | 0.5% | 0.3% |
| Citrate | 0.1% | 0.5% | 0.3% | 0.8% | — |
| NaCl | 0.3% | 0.6% | 0.2% | — | — |
| Sodium cumene sulfonate | — | — | 2% | — | 3.5% |
| Sucrose esters having esterification level of 6-8 with $C_{16}$-$C_{18}$ fatty acids | 3% | 0.25% | 10% | — | — |
| PEG-75 lanolin (such as Solan E ® from Croda International) | — | 2% | — | 5% | 7% |
| cationic polymer (2) | 0.2% | 0.25% | — | 0.25% | 0.1% |
| Protease (ppm) Purafect Prime ™ from Genencor | 50 | 30 | 65 | 100 | 70 |
| Ethylene glycol distearate | 1.2% | — | 0.01% | — | — |
| Hydrogenated Castor Oil | — | 0.14% | 0.3% | 0.1% | — |
| Mica (BASF Mearlin superfine) | — | 0.1% | — | 0.05% | — |
| Minors* | Balance to 100% with water | | | | |
| pH | 7 | 5.5 | 7 | 6 | 6.5 |

| | Ex. 11 | Ex. 12 | Ex. 13 | Ex. 14 | Ex. 15 |
|---|---|---|---|---|---|
| Linear Alkylbenzene Sulfonate | 13% | — | — | — | — |
| Alkyl $C_{10-16}$ Ethoxy$_{0.2-4}$ Sulfate | 5% | 18% | 17% | 4% | 3% |
| Paraffin Sulfonate | — | — | 3% | 10% | — |
| Coco amido propyl Betaine | — | — | 5% | 1% | — |
| Ethoxylated alkyl alcohol | 1.5% | — | 1% | 0.5% | 29% |
| Di-methyl Coco Amine Oxide | 0.5% | 6% | 2% | 1.5% | 3% |
| Ethanol | 3% | — | 2% | 3% | 9.5% |
| Polypropyleneglycol | 0.5% | — | 1% | — | — |
| Citrate | 0.6% | 0.5% | 1.5% | — | — |
| NaCl | 0.5% | 0.5% | — | 1% | — |
| Sodium cumene sulfonate | — | — | — | — | 2.9% |
| Mixture of hydrogenated castor oil and castor oil (Castorlatum ® from Vertellus) | 5% | 2.7% | 1% | 2.25% | 3% |
| Petrolatum | — | — | — | 0.75% | — |
| cationic polymer (3) | 0.1% | 0.15% | — | 0.05% | 0.2% |
| Protease (ppm) Purafect Prime ™ from Genencor | 50 | 70 | 60 | 90 | 45 |
| Ethylene glycol distearate | 0.4% | 0.05% | — | — | 1% |
| Hydrogenated Castor Oil | — | — | — | 0.15% | — |
| Mica (BASF Mearlin superfine) | — | 0.025% | — | 0.2% | — |
| Minors* | Balance to 100% with water | | | | |
| pH | 5 | 9 | 7.5 | 7.7 | 7.5 |

*Minors: dyes, opacifier, perfumes, preservatives, hydrotropes, processing aids, rheology modifiers and/or stabilizers.

(1) Cationically modified hydroxyethyl cellulose (Polyquaternium-10).

(2) A copolymer of acrylamide and diallyl dimethyl ammonium salt - CTFA name: Polyquaternium-7

(3) Guar hydroxypropyl trimmonium chloride

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aqueous hand dishwashing composition comprising a hydrophobic emollient and a serine protease, wherein said serine protease is comprised at a level of from about 0.0001% to about 0.5% of enzyme protein by weight of the total composition, wherein the hydrophobic emollient is comprised at a level of from about 0.25% to about 10%, by weight of the composition, and is selected from the group consisting of petrolatum, mineral oil, castor oil, and mixtures thereof, wherein the crystalline structurant is a blend of from about 0.02% to about 5%, by weight of the composition, of hydrogeneated castor oil and about 0.00001% to about 1.5%, by weight of the composition, of ethylene glycol distearate.

2. A composition according to claim 1 wherein said protease is a subtilisin derived from *Bacillus lentus, Bacillus licheniformis, Bacillus alkalophilus, Bacillus subtilis, Bacil-*

*lus amyloliquefaciens, Bacillus pumilus, Bacillus gibsonii*, or *Bacillus Cellumonas* and/or mixtures thereof.

3. A composition according to claim 1 wherein said protease is a subtilisin BPN' protease derived from *Bacillus amyloliquefaciens* comprising the Y217L mutation.

4. A composition according to claim 1 wherein said crystalline structurant is comprised at a level of from about 0.02% to about 5%.

5. A composition according to claim 1 further comprising from about 4% to about 40% of an anionic surfactant and no more than about 15% by weight of the composition of a sulfonate surfactant.

6. A composition according to claim 1 further comprising from about 0.01% to about 20% by weight of the composition of a surfactant selected from the group consisting of an amphoteric surfactant, a zwitterionic surfactant, and mixtures thereof.

7. A composition according to claim 1 further comprising from about 0.01% to about 20% by weight of the composition of a coco dimethyl amine oxide.

8. A composition according to claim 1 further comprising from about 0.1% to about 45% by weight of the composition of a nonionic surfactant selected from the group consisting of $C_8$-$C_{22}$ aliphatic alcohols with about 1 to about 25 moles of ethylene oxide, alkylpolyglycosides, fatty acid amide surfactants, and mixtures thereof.

9. A composition according to claim 1 further comprising a humectant, preferably a humectant selected from the group consisting of glycerol, urea and mixtures thereof.

10. A composition according to claim 1 further comprising a cationic polymer.

11. A composition according to claim 1 further comprising a pearlescent agent.

12. The use of a hydrophobic emollient and a protease in the liquid hand dishwashing composition of claim 1 for hand skin care benefits.

* * * * *